US008684016B2

(12) United States Patent
Ryu et al.

(10) Patent No.: US 8,684,016 B2
(45) Date of Patent: Apr. 1, 2014

(54) DISH WASHING MACHINE

(75) Inventors: Jung Chan Ryu, Suwon-si (KR); Sung Jin Kim, Suwon-si (KR); Jeon Suk Wee, Suwon-si (KR); Young Ho Kwon, Seongnam-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1022 days.

(21) Appl. No.: 12/458,839

(22) Filed: Jul. 23, 2009

(65) Prior Publication Data

US 2010/0108110 A1 May 6, 2010

(30) Foreign Application Priority Data

Oct. 31, 2008 (KR) ..... 10-2008-107640

(51) Int. Cl.
*A47L 15/02* (2006.01)

(52) U.S. Cl.
USPC ..... 134/184; 134/56 D; 134/57 D; 134/58 D; 134/105; 134/198

(58) Field of Classification Search
USPC ..... 134/56 D, 57 D, 58 D, 105, 184, 198
See application file for complete search history.

(56) References Cited

U.S. PATENT DOCUMENTS

| | | | | |
|---|---|---|---|---|
| 5,299,586 | A * | 4/1994 | Jordan et al. | 134/111 |
| 5,377,707 | A * | 1/1995 | Young, Jr. | 134/104.1 |
| 5,429,679 | A * | 7/1995 | Young, Jr. | 134/25.2 |
| 5,900,070 | A * | 5/1999 | Jarvis et al. | 134/18 |
| 6,418,943 | B1 * | 7/2002 | Miller | 134/104.1 |
| 7,232,494 | B2 * | 6/2007 | Rappette | 134/18 |
| 2007/0102028 | A1 * | 5/2007 | Yoon et al. | 134/56 D |

FOREIGN PATENT DOCUMENTS

| | | |
|---|---|---|
| KR | 10-2007-0074271 | 7/2007 |
| KR | 10-0772229 | 10/2007 |

* cited by examiner

*Primary Examiner* — Michael Barr
*Assistant Examiner* — Benjamin L Osterhout
(74) *Attorney, Agent, or Firm* — Staas & Halsey LLP

(57) ABSTRACT

Disclosed herein is a dish washing machine including a sump unit capable of supplying, to an injection nozzle, wash water flowing in accordance with operation of an impeller, without using a separate channel member. The dish washing machine includes a body provided with a washing tub, a sump unit arranged in the washing tub, and at least one injection nozzle to inject wash water into the washing tub. The sump unit includes a sump housing, an impeller arranged in the sump housing, to pump wash water from the sump housing, and a guide member, to which the sump housing is mounted. The guide member guides the wash water pumped by the impeller directly to the injection nozzle.

12 Claims, 5 Drawing Sheets

DISH WASHING MACHINE

CROSS-REFERENCE TO RELATED APPLICATIONS

This application claims the benefit of Korean Patent Application No. 2008-107640, filed on Oct. 31, 2008 in the Korean Intellectual Property Office, the disclosure of which is incorporated herein by reference.

BACKGROUND

1. Field

Embodiments of the present invention relate to a dish washing machine including a sump unit to store wash water, and to supply the wash water to an injection nozzle via an inner channel by rotating an impeller.

2. Description of the Related Art

Generally, a dish washing machine includes a body provided with a washing tub, a dish basket arranged in the washing tub, an injection nozzle to inject wash water onto the dish basket, and a sump unit connected to the injection nozzle, to pump the wash water to the injection nozzle.

The sump unit included in such a conventional dish washing machine includes a sump housing, an impeller arranged in the sump housing, a channel connected to the impeller, to guide wash water to the injection nozzle, a garbage chamber to collect garbage contained in the wash water in a mixed state, a drainage pump connected to the garbage chamber, and a filter cover to cover the garbage chamber. The filter cover includes a filter to filter the wash water introduced into the garbage chamber, in order to separate the garbage from the wash water.

In the sump unit, the wash water is highly pressurized in accordance with rotation of the impeller, thereby forming a water flow in a direction tangential to the rotation direction of the impeller. In the above-mentioned conventional dish washing machine, the impeller is centrally arranged in the sump unit, and the injection nozzle to inject the wash water is arranged at a center top portion of the sump unit such that the rotation center of the injection nozzle is concentric with the sump unit. Due to such an arrangement, it may be necessary to provide a separate channel member between the impeller and the injection nozzle, in order to guide the high-pressure wash water toward the center top portion of the sump unit.

Due to the provision of such a channel member, the volume of the sump unit may be increased, so that the washing space defined in the washing tub may be relatively reduced in volume.

In such a conventional dish washing machine, a heater may be installed on the bottom of the washing tub, in order to increase a washing force of the dish washing machine. In this case, however, spoons or other kitchen utensils made of wood or plastic may fall to the bottom of the washing tub by the high-pressure wash water injected from the injection nozzle during a washing process. These utensils may be damaged due to high heat from the heater. Furthermore, there may be a danger of burning when the user comes into contact with the heater after opening a door in an operation state of the heater.

In order to avoid damage of kitchen utensils caused by the heater and accidents caused by carelessness of the user, a cover may be installed on the heater. In this case, however, a reduction in the washing space defined in the washing tub may occur due to the heater cover.

SUMMARY

Therefore, it is an aspect of the present invention to provide a dish washing machine including a sump unit capable of supplying, to an injection nozzle, wash water flowing in accordance with operation of an impeller, without using a separate channel member.

It is another aspect of the present invention to provide a dish washing machine including a sump unit, in which a channel to guide a flow of high-pressure wash water generated by an impeller to an injection nozzle is formed on the same plane as the impeller, so that the sump unit may have a compact structure.

It is another aspect of the present invention to provide a dish washing machine including a sump unit, in which an impeller is arranged such that a mounting space for a heater may be provided in a sump housing.

It is a further aspect of the present invention to provide a dish washing machine including a sump unit, in which a heater is arranged on a bottom of a sump housing, to achieve an increase in the washing space of a washing tub, and to prevent the heater from overheating even when a minimum amount of water is present in the sump unit.

Additional aspects of the invention will be set forth in part in the description which follows and, in part, will be apparent from the description, or may be learned by practice of the invention.

The foregoing and/or other aspects of the present invention may be achieved by providing a dish washing machine including a body, a washing tub in the body, a sump unit in the washing tub, and an injection nozzle to inject wash water into the washing tub, the sump unit including a sump housing, an impeller arranged in the sump housing, to pump wash water from the sump housing, and a guide member, to which the sump housing is mounted, the guide member guiding the wash water pumped by the impeller directly to the injection nozzle.

The sump unit may further include a housing cover to cover the sump housing, the housing cover being directly connected to the guide member.

The at least one injection nozzle may be rotatably coupled to a central portion of the housing cover. The impeller may be arranged at a position laterally spaced apart from the central portion of the housing cover.

The sump unit may further include a heater to heat the wash water in the sump housing. The heater may be arranged at a position opposite to the impeller with respect to the central portion of the housing cover.

The guide member may include a mounting portion, to which the impeller is mounted, and a channel extending spirally from a center of the mounting portion.

The at least one injection nozzle may include a plurality of injection nozzles, and the plurality of injection nozzles may include a first injection nozzle directly connected to the sump unit, and a second injection nozzle connected to the sump unit via an extension channel.

The channel may be branched into a first channel to guide a flow of water to the first injection nozzle, and a second channel to guide a flow of water to the extension channel.

The sump unit may include a valve arranged in the second channel, to open or close the second channel.

The foregoing and/or other aspects of the present invention may be achieved by providing a dish washing machine including a body, a washing tub, a sump unit arranged in the washing tub, and an injection nozzle rotatably coupled to the sump unit, wherein the sump unit includes a sump housing, an impeller to pump wash water, the impeller having a rotating center spaced apart from a rotating center of the injection nozzle, and a guide member, to which the sump housing is mounted, the guide member guiding the wash water pumped by the impeller, to a region defined beneath the rotating center of the injection nozzle.

The sump unit may further include a sump housing to receive the impeller and the guide member, and a housing cover to cover the sump housing, the housing cover having a through hole formed at a position corresponding to the rotating center of the injection nozzle.

The sump unit may further include a heater arranged at a bottom of the sump housing, to heat the wash water.

The heater may be arranged at a position opposite to the impeller with respect to the rotating center of the injection nozzle.

The guide member may include a mounting portion, to which the impeller is mounted, and a channel to guide the wash water discharged from the impeller to a region defined beneath the rotating center of the injection nozzle.

The foregoing and/or other aspects of the present invention may be achieved by providing a dish washing machine including a body, a washing tub in the body, a sump housing arranged at a bottom of the washing tub, an impeller arranged such that the impeller is eccentric from a center of the sump housing, to pump wash water from the sump housing, a guide member, to which the sump housing is mounted, the guide member guiding a flow of water discharged from the impeller toward a central portion of the sump housing, a housing cover to cover the sump housing and the guide member, the housing cover having a through hole formed at a position corresponding to the center of the sump housing, to allow flow of the wash water from the guide member, and an injection nozzle rotatably coupled to the through hole.

The dish washing machine may further include a heater to heat the wash water in the sump housing, the heater being arranged at a position opposite to the impeller with respect to the central portion of the sump housing.

The foregoing and/or other aspects of the present invention may be achieved by providing a dish washing machine including a body, a washing tub in the body, a sump housing arranged at a bottom of the washing tub, an injection nozzle rotatably mounted to the sump housing, an impeller arranged at the sump housing such that the impeller is eccentric from a rotating center of the injection nozzle, to pump wash water from the sump housing, a guide member to guide a flow of water discharged from the impeller to the injection nozzle, and a heater arranged beneath the guide member while being opposite to the impeller.

The impeller may be mounted to the guide member. The guide member may include a channel to guide the water flow discharged from the impeller directly to the rotating center of the injection nozzle.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION OF EMBODIMENTS

Figure 1:
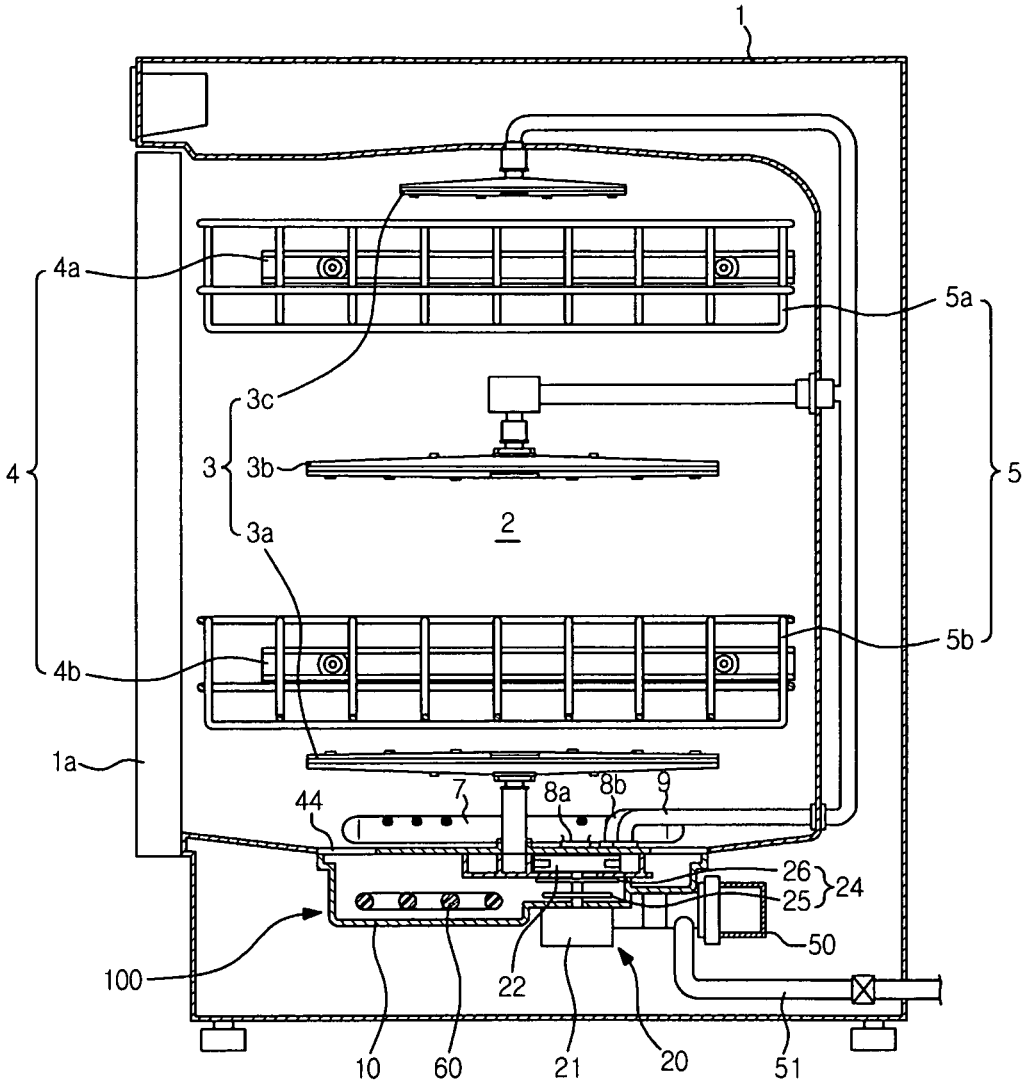
FIG. 1 is a lateral sectional view of a dish washing machine according to an exemplary embodiment of the present invention.

Reference will now be made in detail to the embodiments, examples of which are illustrated in the accompanying drawings, wherein like reference numerals refer to like elements throughout.

Figure 2:
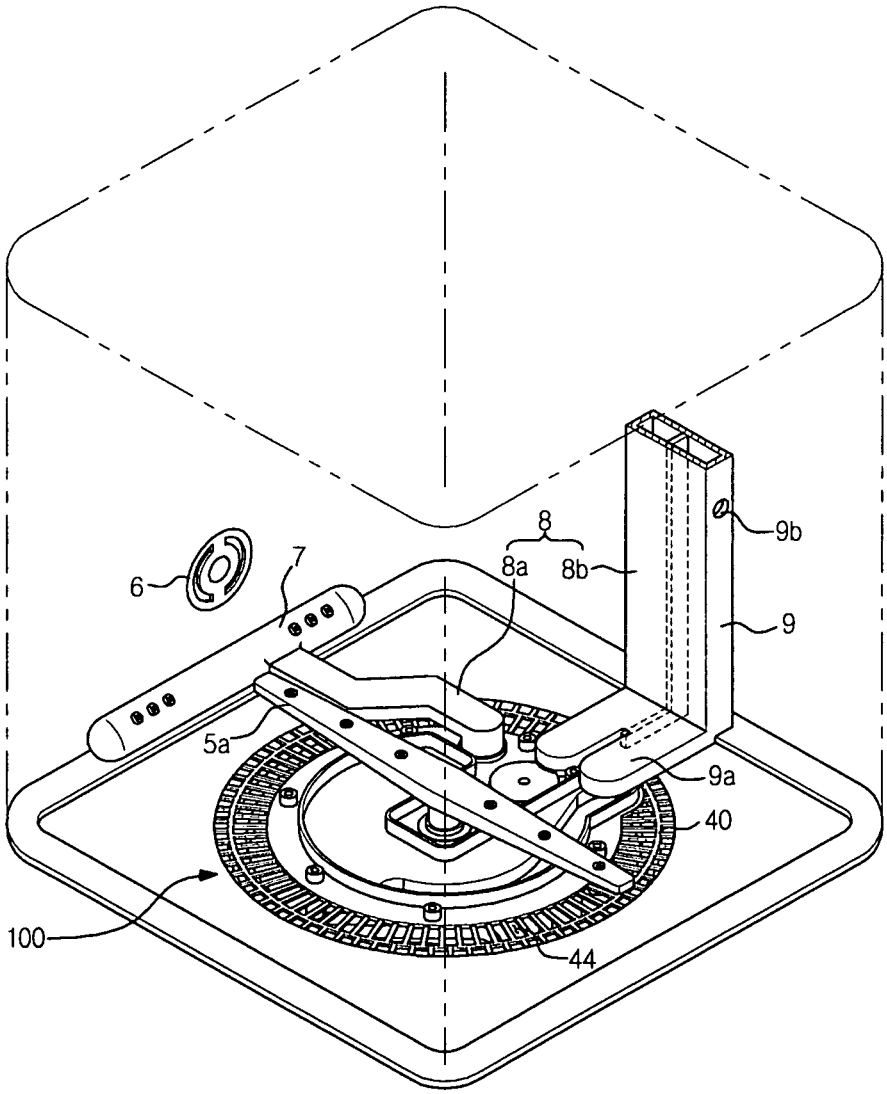
FIG. 2 is a perspective view schematically illustrating an interior of the dish washing machine according to the illustrated embodiment of the present invention.

FIG. 1 is a lateral sectional view of a dish washing machine according to an exemplary embodiment of the present invention. FIG. 2 is a perspective view schematically illustrating the interior of the dish washing machine according to the illustrated embodiment of the present invention.

As shown in FIGS. 1 and 2, the dish washing machine according to the illustrated embodiment of the present invention includes a body 1 to define an outer appearance of the dish washing machine, a door 1*a* rotatably coupled to a front wall of the body 1, and a washing tub 2 arranged in the body 1. The dish washing machine also includes a sump unit 100 arranged on the bottom of the washing tub 2, to contain wash water and to pump the contained wash water, and injection nozzles 3, specifically, injection nozzles 3*a*, 3*b*, and 3*c*, to inject the wash water pumped by the sump unit 100 into the washing tub 2.

Racks 4, specifically, racks 4*a* and 4*b*, are arranged in the washing tub 2 such that they may be loaded in and unloaded from the washing tub 2.

The racks 4 include an upper rack, namely, the rack 4*a*, arranged at an upper portion of the washing tub 2, and a lower rack, namely, the rack 4*b*, arranged at a lower portion of the washing tub 2. The racks 4*a* and 4*b* are slidably mounted to a side wall of the washing tub 2.

Dish baskets 5, specifically, dish baskets 5*a* and 5*b*, are coupled to the upper and lower racks 4*a* and 4*b*, respectively. Tableware such as dishes may be placed in the dish baskets 5.

A water supply port 6 is provided at one side wall of the washing tub 2, to enable wash water supplied from a water supply source to be introduced into the washing tub 2. The wash water supplied through the water supply port 6 falls to the bottom of the washing tub 2, and is then introduced into the sump unit 100 via an inlet 44 formed through a housing cover 40 of the sump unit 100. The housing cover 40 will be described later.

The injection nozzles 3 are arranged such that they are rotatable by an injection pressure of injected wash water. The injection nozzles 3 may include a first injection nozzle, namely, the injection nozzle 3*a*, arranged between the sump unit 100 and the lower rack 4*b*, a second injection nozzle, namely, the injection nozzle 3*b*, arranged between the upper and lower racks 4*a* and 4*b*, and a third injection nozzle, namely, the injection nozzle 3*c*, arranged over the upper rack 4*a*.

The first injection nozzle 3*a* is directly connected to a central portion of the top of the sump unit 100 while being rotatable, to inject a part of wash water pumped from the sump unit 100 toward the dish basket 5*b* arranged adjacent to the first injection nozzle 3*a*.

The second and third injection nozzles 3*b* and 3*c* inject the remaining part of the wash water pumped from the sump unit 100 toward the dish baskets 5*a* and 5*b* arranged adjacent to the second and third injection nozzles 3*b* and 3*c*, respectively.

An auxiliary injection nozzle 7 may also be arranged at a lower portion of the washing tub 2 adjacent to one side of the washing tub 2 in the illustrated embodiment. The auxiliary injection nozzle 7 injects wash water to a dead area where the wash water injected from the injection nozzles 3 may not reach, to achieve an enhancement in washing efficiency.

The injection directions of the injection nozzles 3 and auxiliary injection nozzle 7 are directed to the associated dish baskets 5. The wash water injected from the injection nozzles 3 and auxiliary injection nozzle 7 strikes dishes placed in the dish baskets 5, thereby achieving a thorough washing.

The second and third injection nozzles 3*b* and 3*c*, and the auxiliary injection nozzle 7 are connected to the sump unit 100 via extension channels 8. The extension channels 8 include a first extension channel 8*a* to connect the auxiliary injection nozzle 7 to the sump unit 100, and a second extension channel 8*b* extending along a rear wall of the washing tub 2, to connect the second and third injection nozzles 3*b* and 3*c* to the sump unit 100.

The extension channels 8 are connected to the sump unit 100, to guide wash water flowing in accordance with a high pumping pressure of the sump unit 100 such that the wash water is supplied to the auxiliary injection nozzle 7 and second and third injection nozzles 3*b* and 3*c*.

A bypass channel 9 is arranged at one side of the second extension channel 8*b* such that the bypass channel 9 and second extension channel 8*b* extend in parallel.

A bypass tube 9*a* is provided at one end, namely, a lower end, of the bypass channel 9, to receive wash water from a garbage chamber 45, which will be described later. At the other end, namely, an upper end, of the bypass channel 9, a hole 9*b* is formed to allow the wash water rising along the bypass channel 9 to overflow toward the washing tub 2.

The bypass tube 9*a* is provided to bypass a part of wash water when the pressure of the wash water is abnormally increased due to accumulation of contaminants such as garbage in the garbage chamber 45.

A check valve may be arranged in the bypass tube 9*a*, to allow wash water introduced into the bypass tube 9*a* to flow upward through the bypass tube 9*a* when the pressure of the wash water is equal to or higher than a predetermined pressure. In the illustrated embodiment, however, the bypass of the wash water is achieved based on a height of the wash water in the bypass channel 9 varying in accordance with the pressure of the wash water, without using a check valve.

In the illustrated embodiment, the wash water introduced into the bypass tube 9*a* is maintained at a certain height in the bypass channel 9 when the water pressure in the sump unit 100 is lower than a predetermined pressure. However, when the water pressure in the sump unit 100 is equal to or higher than the predetermined pressure, the wash water in the bypass channel 9 rises along the bypass channel 9, so that it is discharged into the washing tub 2 through the hole 9*b* formed at the upper end of the bypass channel 9, thereby maintaining the garbage chamber 45 at a desired pressure.

The sump unit 100 is mounted on the bottom of the washing tub 2. As described above, the sump unit 100 contains wash water, and pumps the wash water, to supply the wash water to the injection nozzles 3 and auxiliary injection nozzle 7.

Figure 3:
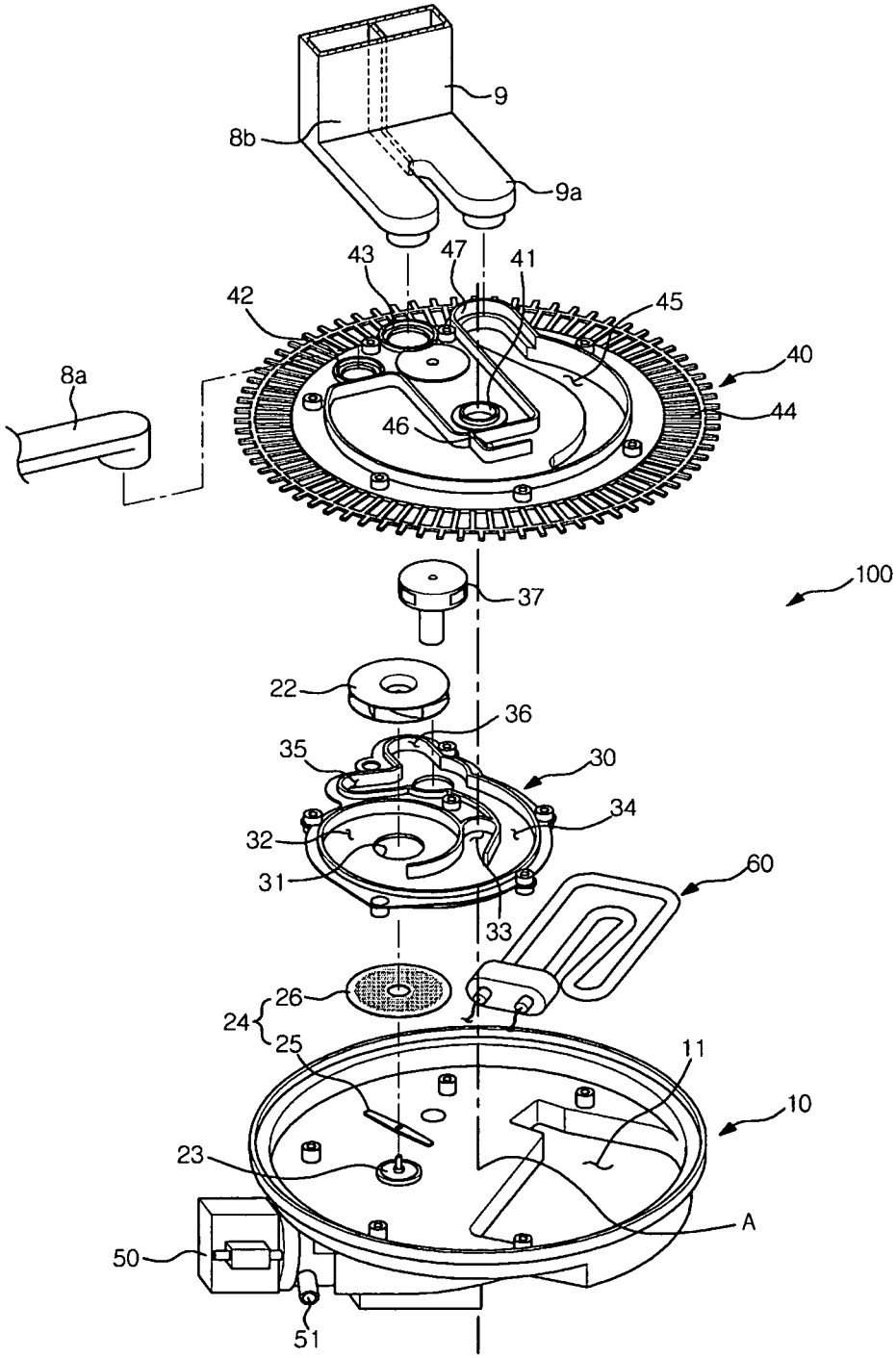
FIG. 3 is an exploded perspective view of a sump unit of the dish washing machine according to an exemplary embodiment of the present invention.
Figure 4:
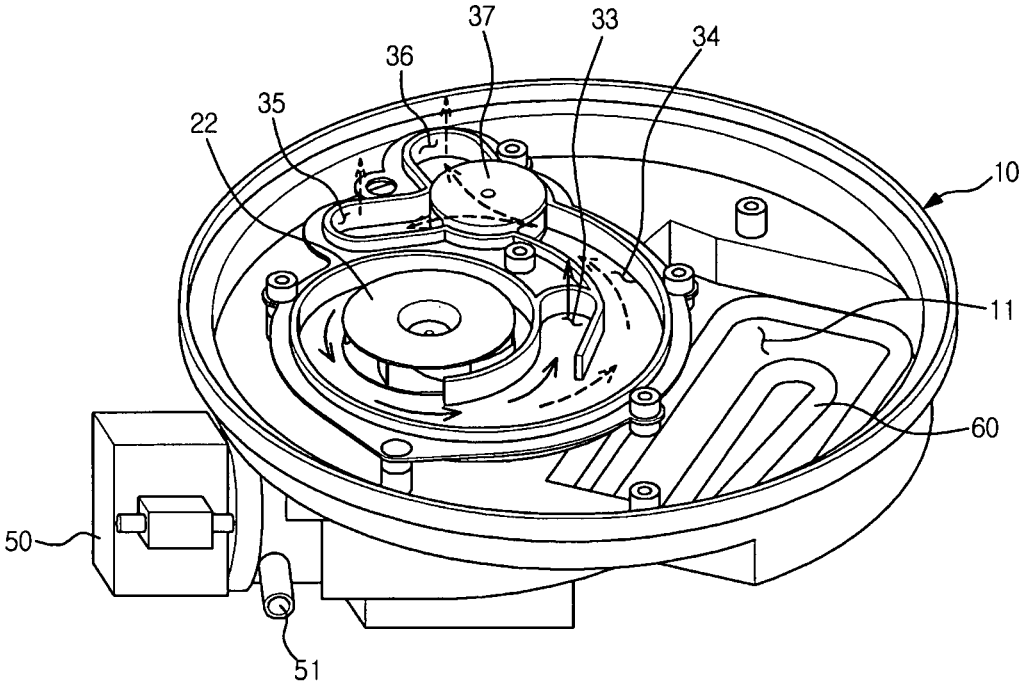
FIG. 4 is an exploded perspective view illustrating a state in which a housing cover is separated from the sump unit in the dish washing machine according to the illustrated embodiment of the present invention.
Figure 5:
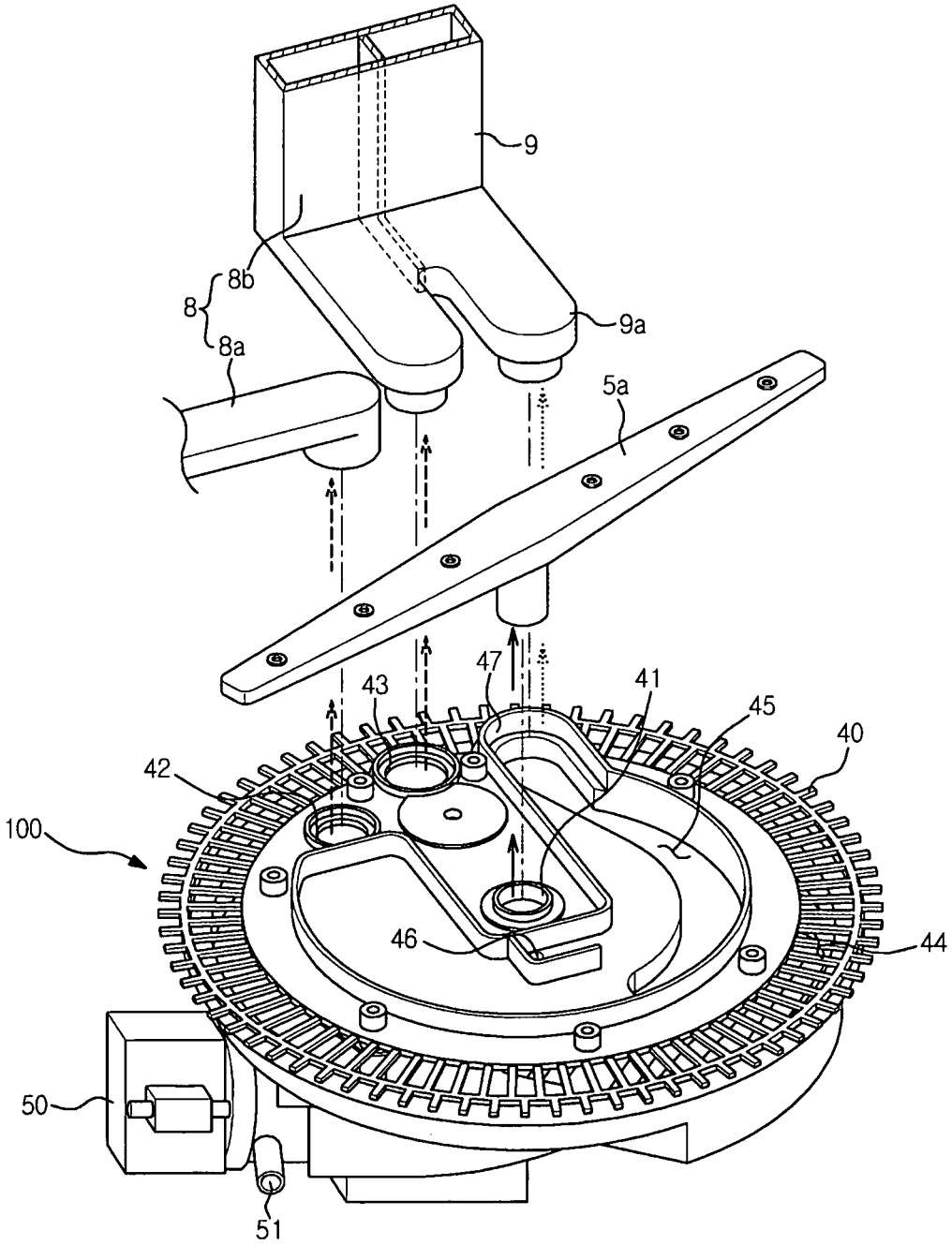
FIG. 5 is an exploded perspective view illustrating a state in which injection nozzles are separated from the sump unit of the dish washing machine according to the illustrated embodiment of the present invention.

FIG. 3 is an exploded perspective view illustrating a configuration of the sump unit of the dish washing machine according to an exemplary embodiment of the present invention. FIG. 4 is an exploded perspective view illustrating a state in which a housing cover is separated from the sump unit of the dish washing machine according to the illustrated embodiment of the present invention. FIG. 5 is an exploded perspective view illustrating a state in which injection nozzles are separated from the sump unit of the dish washing machine according to the illustrated embodiment of the present invention.

The sump unit 100 includes a sump housing 10 to define an outer appearance of the sump unit 100, and a washing pump 20 to pump wash water, a guide member 30 mounted to the sump housing 10, to guide a flow of the wash water pumped by the washing pump 20. The housing cover 40 is also included in the sump unit 10, to cover the sump housing 10.

The sump housing 10 has a substantially circular structure, and is downwardly recessed to accommodate various constituent elements.

The washing pump 20 is mounted at a position spaced apart from a central portion A of the sump housing 10 in one radial direction. A heater 60 to heat wash water is mounted at a position spaced apart from the central portion A of the sump housing 10 in a direction opposite to the washing pump 20.

The washing pump 20 includes a pump motor 21 fixedly mounted to the sump housing 10 beneath the sump housing 10, and an impeller 22 fixedly mounted to a rotating shaft of the pump motor 21. A cutting unit 24 to cut garbage may be arranged between the pump motor 21 and the impeller 22.

The pump motor 21 is mounted to the bottom of the sump housing 10 at the outside of the sump housing 10. The rotating shaft of the pump motor 21 is upwardly protruded through the bottom of the sump housing 10.

A sealing member 23 is arranged on the bottom of the sump housing 10 such that it surrounds the rotating shaft of the pump motor 21, to prevent wash water from being leaked toward the pump motor 21.

The impeller 22 is arranged on an upper surface of the guide member 30 while having a structure capable of axially receiving wash water, and then radially discharging the wash water.

The cutting unit 24 functions to cut contaminants such as garbage introduced in the sump unit 100 into fragments. The cutting unit 24 includes a cutter 25 coupled to the rotating shaft of the pump motor 21 such that it is rotated in accordance with rotation of the rotating shaft, and a garbage filter 26 arranged over the cutter 25, to prevent relatively-large lumps of garbage from being introduced into the impeller 22.

The heater 60 is mounted to the sump housing 10, in order to enhance a cleaning performance of wash water. The sump housing 10 is formed with a heater installation recess 11 downwardly concaved while having a size corresponding to the heater 60. The heater 60 is accommodated in the heater installation recess 11.

Since the washing pump 20 is arranged at a position spaced apart from the central portion A of the sump housing 10 by a certain distance, it is possible to secure a space capable of providing the heater installation recess 11 at the bottom of the sump housing 10.

In conventional cases, it may be difficult to secure a space for installing a heater around the washing pump because the washing pump is arranged at the central portion of the sump housing. In an exemplary embodiment of the present invention, however, the washing pump is arranged at a position eccentric from the central portion of the sump housing so that a heater installation recess may be provided at a position opposite to the washing pump.

The heater 60 is received in the heater installation recess 11 formed at a lower portion of the sump housing 10. In an exemplary embodiment of the present invention, the heater installation recess 11 may be formed at a lowest position of the space of the sump housing 10. Accordingly, even when the amount of wash water introduced into the sump housing 10 is relatively small, the level of the wash water may be higher than the installation level of the heater 60, so that the heater 60 may not be exposed from the surface of the wash water. Thus, it may be possible to prevent the heater 60 from being overheated.

A drainage pump 50 and a drainage tube 51 are arranged beneath the sump housing 10 at one side of the sump housing 10, to discharge wash water and garbage from the sump unit 100 to the outside of the dish washing machine (FIGS. 1 and 3).

The impeller 22 is mounted to the sump housing 10. The guide member 30 is also mounted to the sump housing 10, to guide a flow of the wash water discharged by the impeller 22.

The guide member 30 includes a through hole 31 to receive wash water from the sump housing 10, a mounting portion 32 formed around the through hole 31, to provide a mounting space for the impeller 22, and channels 33 and 34 spirally defined around the mounting portion 32.

The garbage filter 26 is arranged beneath the through hole 31, to prevent relatively-large lumps of garbage from being introduced into the impeller 22.

The impeller 22 functions to pump wash water from the sump housing 10 to the guide member 30 by upwardly sucking wash water introduced into the sump housing 10 and fine garbage contained in the wash water, and then radially discharging the wash water and garbage while rotating together with the rotating shaft of the pump motor 21.

The channels 33 and 34 may include a first channel, namely, the channel 33, branched from the mounting portion 32, to guide wash water to the first injection nozzle 3*a*, and a second channel, namely, the channel 34, branched from the mounting portion 32, to guide wash water to the extension channel 9.

The first and second channels 33 and 34 extend spirally around the mounting portion 32. The first channel 33 extends toward the central portion of the sump unit 100, whereas the second channel 34 extends toward a peripheral edge of the sump unit 100.

The first channel 33 is formed to directly supply a flow of water discharged from the impeller 22 to the first injection nozzle 3*a*, without using a separate channel member.

The second channel 34 is divided into a first branched channel 35 communicating with the first extension channel 8*a*, and a second branched channel 36 communicating the second extension channel 8*b*.

A valve 37 is pivotally installed in the second channel 34. The valve 37 functions to selectively open and close the first and second branched channels 35 and 36.

When the amount of dishes to be washed is large, the valve 37 opens the second branched channel 36 while closing the first branched channel 35. In this case, wash water flows only through the second branched channel 36, to supply the wash water to the second extension channel 8*b*. The wash water supplied to the second extension channel 8*b* is injected through the auxiliary injection nozzle 7, to wash the dishes.

On the other hand, when the amount of dishes to be washed is small, the valve 37 opens the first branched channel 35 while closing the second branched channel 36. In this case, wash water flows only through the first branched channel 35, to supply the wash water to the first extension channel 8*a*. The wash water supplied to the first extension channel 8*a* is injected through the second and third injection nozzles 3*b* and 3*c*, to wash the dishes.

The housing cover 40 is arranged over the guide member 30. As described above, the housing cover 40 covers the top of the sump housing 10, in which the guide member 30 is placed.

A through hole 41 is formed through a central portion of the housing cover 40. The through hole 41 communicates with the first channel 33, to allow the wash water from the first channel 33 to be supplied to the first injection nozzle 3*a*. The garbage chamber 45 is formed around the through hole 41. An inlet 44 is circumferentially formed around a peripheral edge of the housing cover 40, to allow the wash water from the washing tub 2 to be introduced into the sump unit 100.

An opening 46 is also formed through the housing cover 40, to allow the wash water and garbage introduced into the guide member 30 to be introduced into the garbage chamber 45.

In this case, the central portion A of the sump housing 10 in the sump housing 100 is axially aligned with one side of the first channel 33 in the guide member 30 and the through hole 41 of the housing cover 40 communicating directly with the one side of the first channel 33.

The housing cover 40 also includes a first coupling portion 42 to be coupled with the first extension channel 8*a* for the supply of wash water to the auxiliary injection nozzle 7, a second coupling portion 43 to be coupled with the second extension channel 8*b* for the supply of wash water to the second and third injection nozzles 3*b* and 3*c*, and a third coupling portion 47 to be coupled with the bypass channel 9.

Fine garbage introduced into the guide member 30 via the garbage filter 26 by the impeller 22 after being cut by the cutter 25 is subsequently introduced into the garbage chamber 45 in the housing cover 40 through the opening 46, together with the wash water. The garbage chamber 45 collects the fine garbage introduced in the above-described manner, together with the wash water.

The bottom of the garbage chamber 45 is connected to the drainage pump 50, so that garbage collected in the garbage chamber 45 is drained to the outside of the dish washing machine via the drainage tube 51 during operation of the drainage pump 50. The top of the garbage chamber 45 is connected to the bypass channel 9, so that the wash water in the bypass channel 9 rises or falls in accordance with an inner water pressure of the garbage chamber 45.

A filter cover (not shown) having a mesh structure may also be provided at the top of the housing cover 40, to prevent the garbage collected in the garbage chamber 45 from overflowing the garbage chamber 45 while allowing only the wash water in the garbage chamber 45 to flow outwardly from the garbage chamber 45.

The first injection nozzle 3*a* is rotatably coupled to the through hole 41. The wash water in the first channel 33 rises upward due to a water pressure generated in accordance with the operation of the impeller 22, so that it is supplied to the first injection nozzle 3*a* through the through hole 41 of the housing cover 40.

Similarly, the wash water in the second channel 34 rises upward due to the water pressure, so that it may be selectively introduced into the first extension channel 8*a* or second extension channel 8*b* through the first coupling portion 42 or second coupling portion 43. In this case, accordingly, the wash water is supplied to the auxiliary injection nozzle 7 or the second and third injection nozzles 3*b* and 3*c*.

Thus, in the dish washing machine according to the illustrated embodiment of the present invention, the first channel 33 to guide a flow of water discharged from the impeller 22 to the central portion of the sump unit, namely, the through hole 41 of the housing cover 40, to which a rotating shaft of the first injection nozzle 3*a* is mounted, may be formed at the guide member 30, to which the impeller 22 is mounted, because the impeller 22 is arranged at a position eccentric from the central portion of the sump unit 100.

In conventional cases, a separate channel member is arranged over the guide member, to which the impeller is mounted, in order to guide a flow of water discharged from the impeller to the central portion of the sump unit, because the impeller is axially aligned with the central portion of the sump unit, namely, the rotating shaft of the first injection nozzle. In the dish washing machine according to the illustrated embodiment of the present invention, however, no separate channel member is used. Accordingly, a sump unit having a compact configuration may be implemented, as compared to conventional sump units.

In accordance with the implementation of the sump unit, which has a compact configuration, the space of the washing tub may be relatively increased.

Also, since the impeller is arranged at a position eccentric from the central portion of the sump unit, it may be possible to secure a space enabling the heater to be mounted at a position opposite to the impeller in the sump housing.

Accordingly, the heater may be arranged at a lowest position within the sump housing. Thus, even when the amount of wash water introduced into the sump housing is relatively small, the level of the wash water may be higher than the installation level of the heater, so that the heater may not be exposed from the surface of the wash water. Thus, it may be possible to prevent the heater from being overheated.

Hereinafter, operation of the embodiment of the present invention will be described with reference to the accompanying drawings.

Wash water supplied to the washing tub 2 via the injection nozzles 5 or water supply port 6 is introduced into the sump unit 100 through the inlet 44 of the housing cover 40. The introduced water is then heated by the heater 60.

When the pump motor 21 operates, relatively-large lumps of garbage contained in the wash water are cut into smaller lumps by the cutter 25 coupled to the rotating shaft of the pump motor 21. Fine garbage having a size capable of passing through the garbage filter 26 is fed to the guide member 30, together with the wash water, in accordance with the operation of the impeller 22, as shown in FIG. 4.

The wash water pumped in the above-described manner flows radially after being discharged from the mounting portion 32 by the rotating force of the impeller 22, so that it is introduced into the first and second channels 33 and 34.

The wash water introduced into the first channel 33 flows in a direction indicated by a solid arrow in FIG. 4, so that it is introduced into the first injection nozzle 3*a* via the through hole 41 of the housing cover 40, as shown in FIG. 5.

On the other hand, the wash water introduced into the second channel 34 flows in a direction indicated by a dotted arrow in FIG. 4. As shown in FIG. 5, the wash water in the second channel 34 is then introduced into the first extension channel 8*a* or second extension channel 8*b* via the first coupling portion 42 or second coupling portion 43 of the housing cover 40 in accordance with a switching operation of the valve 37, so that it is supplied to the auxiliary injection nozzle 7 or to the second and third injection nozzles 3*b* and 3*c*.

As is apparent from the above description, in the dish washing machine according to one aspect of the present invention, the impeller is arranged such that it is eccentric from the rotating center of the injection nozzle, and the channel guiding wash water to the rotating center of the injection nozzle is provided at the guide member, to which the impeller is mounted. Accordingly, it may be possible to provide a sump unit having a compact structure without using a separate channel member.

In the dish washing machine according to one aspect of the present invention, the space to receive the heater may be provided at the bottom of the sump housing because the impeller is arranged to be eccentric from the rotating center of the injection nozzle. Since the heater is arranged at the bottom of the sump housing, the washing space of the washing tube may be increased in volume. It may also be possible to prevent the heater from being overheated even when the amount of wash water in the sump housing is relatively small.

Although an embodiment of the present invention has been shown and described, it would be appreciated by those skilled in the art that changes may be made in this embodiment without departing from the principles and spirit of the invention, the scope of which is defined in the claims and their equivalents.

What is claimed is:

1. A dish washing machine comprising:

a body;

a washing tub in the body;

a sump unit in the washing tub;

a first injection nozzle disposed at a center portion of the sump unit and directly connected to the sump unit; and at least one second injection nozzle disposed at an upper side of the first injection nozzle, the sump unit comprising:

a sump housing;

an impeller arranged in the sump housing, to pump wash water from the sump housing; and a guide member, to which the sump housing is mounted, the guide member guiding the wash water pumped by the impeller directly to the injection nozzle, wherein the impeller has a center horizontally offset from a central vertical axis of the sump housing, wherein the guide member comprises a mounting portion to which the impeller is mounted, a first channel branched from the mounting portion while extending toward a center portion of the guide member so as to directly guide a flow of water discharged from the impeller to the first injection nozzle, and a second channel branched from the mounting portion while extending to surround an outer side of the first channel so as to guide the flow of water to the second injection nozzle.

2. The dish washing machine according to claim 1, wherein the sump unit further comprises:

a housing cover to cover the sump housing, the housing cover being directly connected to the guide member.

3. The dish washing machine according to claim 2, wherein:

the first injection nozzle is rotatably coupled to a central portion of the housing cover.

4. The dish washing machine according to claim 3, wherein:

the sump unit further comprises a heater to heat the wash water in the sump housing; and the heater is at a position opposite to the impeller with respect to the central portion of the housing cover.

5. The dish washing machine according to claim 1, wherein the first and second channel extend spirally from a center of the mounting portion.

6. The dish washing machine according to claim 1, further comprising:

an extension channel to connect the sump unit to the second injection nozzle.

7. The dish washing machine according to claim 1, wherein the sump unit further comprises a valve arranged in the second channel, to open or close the second channel.

8. A dish washing machine comprising:

a body;

a washing tub in the body;

a sump unit arranged in the washing tub;

a first injection nozzle disposed at a center portion of the sump unit and directly connected to the sump unit; and at least one second injection nozzle disposed at an upper side of the first injection nozzle, wherein the sump unit comprises:

a sump housing;

an impeller to pump wash water, the impeller having a rotating center; and a guide member, to which the sump housing is mounted, the guide member guiding the wash water pumped by the impeller, to a region defined beneath the rotating center of the injection nozzle, wherein the rotating center of the impeller is horizontally offset from a central vertical axis of the sump housing, wherein the guide member comprises a mounting portion to which the impeller is mounted, a first channel branched from the mounting portion while extending toward a center portion of the guide member so as to directly guide a flow of water discharged from the impeller to the first injection nozzle, and a second channel branched from the mounting portion while extending to surround an outer side of the first channel so as to guide the flow of water to the second injection nozzle.

9. The dish washing machine according to claim 8, wherein the sump unit further comprises:

a housing cover to cover the sump housing, the housing cover having a through hole formed at a position corresponding to a rotating center of the injection nozzle.

10. The dish washing machine according to claim 9, wherein:

the sump unit further comprises a heater arranged at a bottom of the sump housing, to heat the wash water.

11. The dish washing machine according to claim 10, wherein the heater is arranged at a position opposite to the impeller with respect to the rotating center of the injection nozzle.

12. A dish washing machine comprising:

a body;

a washing tub in the body;

a sump unit in the washing tub;

a first injection nozzle disposed so as to rotate on a first rotating center that passes through a center of the sump unit; and at least one second injection nozzle disposed at an upper side of the first injection nozzle, the sump unit comprising:

a sump housing arranged at a bottom of the washing tub;

an impeller disposed at an inside of the sump housing so as to rotate on a second rotating center that is parallel to the first rotating center, the second rotating center being horizontally offset from the first rotating center;

a guide member including a first channel to directly guide a flow of water discharged from the impeller to the first injection nozzle, and a second channel provided at an outer side of the first channel to guide the flow of water discharged from the impeller to the at least one second injection nozzle;

a heater receiving portion formed on the sump housing, and disposed at an opposite position to the impeller while interposing the first rotating center therebetween; and a heater received in the heater receiving portion.

* * * * *